US006394297B1

(12) United States Patent
Nance

(10) Patent No.: US 6,394,297 B1
(45) Date of Patent: May 28, 2002

(54) CONTAINER ATTACHMENT DEVICE AND METHOD OF USE

(76) Inventor: Gary Nance, 1805 Ellison Dr., Modesto, CA (US) 95355

( * ) Notice: Subject to any disclaimer, the term of this patent is extended or adjusted under 35 U.S.C. 154(b) by 0 days.

(21) Appl. No.: 09/590,607

(22) Filed: Jun. 9, 2000

Related U.S. Application Data

(60) Provisional application No. 60/138,704, filed on Jun. 11, 1999.

(51) Int. Cl.[7] ..... B65D 1/36

(52) U.S. Cl. ..... 220/23.4; 220/23.86; 220/482; 220/751

(58) Field of Search ..... 220/23.86, 482, 220/23.4, 751

(56) References Cited

U.S. PATENT DOCUMENTS

| | | | | | |
|---|---|---|---|---|---|
| 1,990,026 | A | * | 2/1935 | Glen, Jr. | 220/482 |
| 2,161,577 | A | * | 6/1939 | Howlett | 220/482 |
| 2,597,468 | A | | 5/1952 | Garrett | |
| 4,094,431 | A | * | 6/1978 | Wheeler | 220/23.86 |
| 4,183,444 | A | | 1/1980 | English et al. | |
| 4,848,580 | A | | 7/1989 | Wise | |
| 4,854,466 | A | | 8/1989 | Lane, Jr. | |
| 5,092,480 | A | | 3/1992 | Waterston | |
| 5,097,975 | A | * | 3/1992 | Waterston et al. | 220/23.86 |
| 5,108,000 | A | | 4/1992 | Stoll et al. | |
| 5,417,338 | A | * | 5/1995 | Roy et al. | 220/23.86 |
| 5,590,804 | A | * | 1/1997 | Crum et al. | 220/23.86 |

* cited by examiner

*Primary Examiner*—Joseph M. Moy
(74) *Attorney, Agent, or Firm*—Eric Karich

(57) ABSTRACT

A container attachment device for attaching a container to a storage container has first and second attachment elements that can be attached to the storage container and the container, respectively, to make them readily interconnectable. The first attachment element has a first anchor having a first adhesive backing for attaching the first attachment element to the storage container; and the first attachment element has a rigid tongue extending upwardly. The second attachment element has second and third anchors connected by a bridge. The second and third anchors have second and third adhesive backings, respectively, for attaching the second attachment element to the storage container. The bridge is shaped to connect the second and third anchors such that when the second and third anchors are attached to the container by the second and third adhesive backings, the rigid tongue of the first attachment element can be removably engaged between the bridge and the container.

1 Claim, 5 Drawing Sheets

CONTAINER ATTACHMENT DEVICE AND METHOD OF USE

CROSS-REFERENCE TO RELATED APPLICATIONS

This application for a utility patent claims the benefit of U.S. Provisional Application No. 60/138,704, filed Jun. 11, 1999.

STATEMENT REGARDING FEDERALLY SPONSORED RESEARCH

Not Applicable

BACKGROUND OF THE INVENTION

1. Field of the Invention

This invention relates generally to containers, and more particularly to a container that can be attached to a storage container.

2. Description of Related Art

There is a need in the marketplace for a container that can be readily attached to a storage container. An example of a market for such a product is in the fast food industry. In the sale of fast food, it is desirable to be able to dispense condiments such as ketchup in a container that can be readily carried with their associated foods, such as french-fries.

It is highly desirable that the container be securely attachable to the storage container so as to prevent spillage; and it is also desirable that the containers be inexpensive to manufacture, store, ship, and use. To meet this goal, the container must have an attachment arm or arms that are both reliable and nestable.

The prior art teaches various containers. However, the prior art does not teach a container that meets the above-described requirements. The present invention fulfills these needs and provides further related advantages as described in the following summary.

SUMMARY OF THE INVENTION

The present invention teaches certain benefits in construction and use, which give rise to the objectives described below.

The present invention provides a container attachment device for attaching a container to a storage container. The container attachment device includes first and second attachment elements that can be attached to the storage container and the container, respectively, to make them readily interconnected. The first attachment element has a means for providing an attachment point. The first attachment element further has a means for attaching the first attachment element to the storage container vertical sidewall of the storage container. The second attachment element has a means for removably engaging the means for providing an attachment point and a means for fastening the second attachment element to the vertical sidewall of the container.

A primary objective of the present invention is to provide a container having advantages not taught by the prior art.

Another objective is to provide a container that is securely attachable to a storage container so as to prevent spillage from the container.

A further objective is to provide a container that can be nested within other containers, thereby reducing the cost of shipping and storage.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
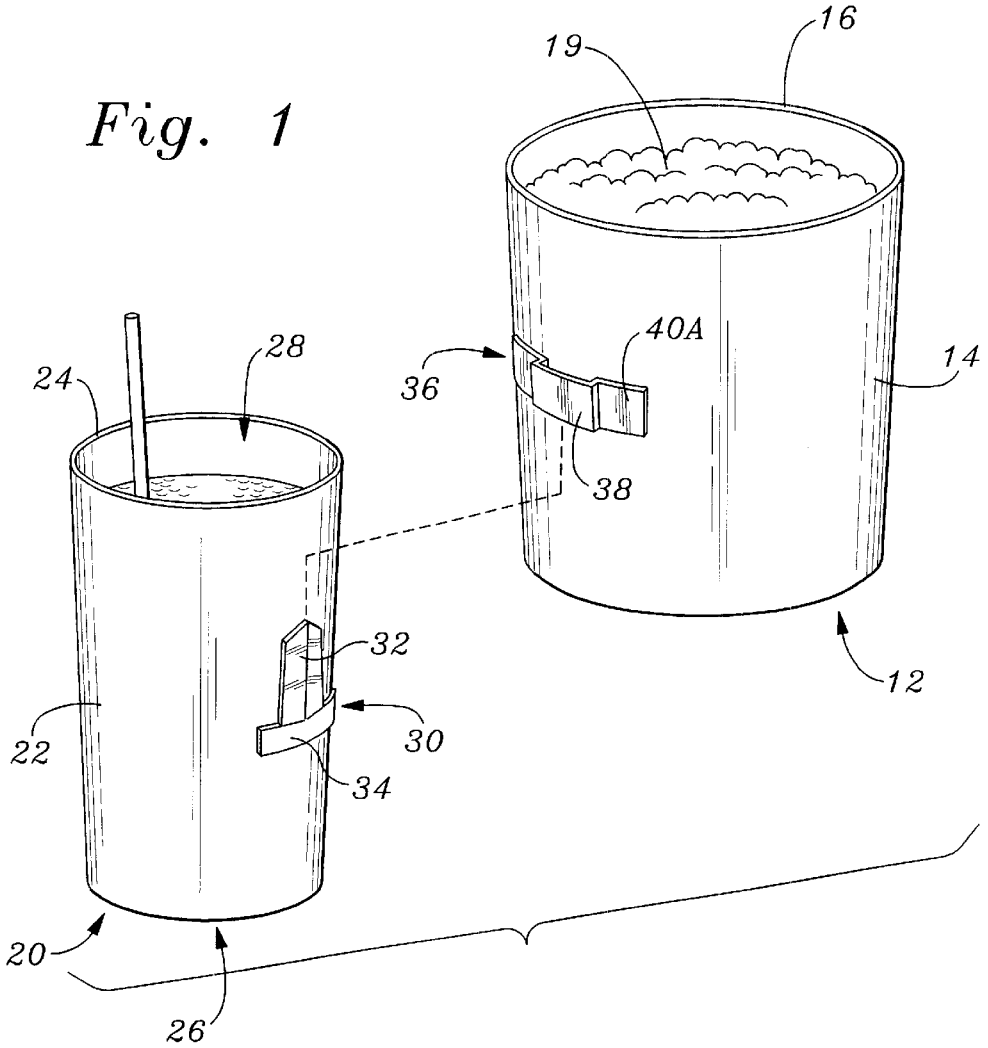
FIG. 1 is an exploded perspective view of the preferred embodiment of the present invention.

The above-described drawing figures illustrate the invention, a container attachment device 10 for attaching a container 12 to a storage container 20. As shown in FIG. 1, the storage container 20 is typically a drink container 12 of the type typically used in movie theaters, or alternatively a french-fry container 12 used in fast food restaurants. The storage container 20 has a storage container vertical sidewall 22 and a storage container bottom 26 that cooperate to define a storage container storage space 28 for storing drink, french-fries, or other fast food items. The storage container vertical sidewall 22 preferably further includes a lip 24, described below.

Figure 5:
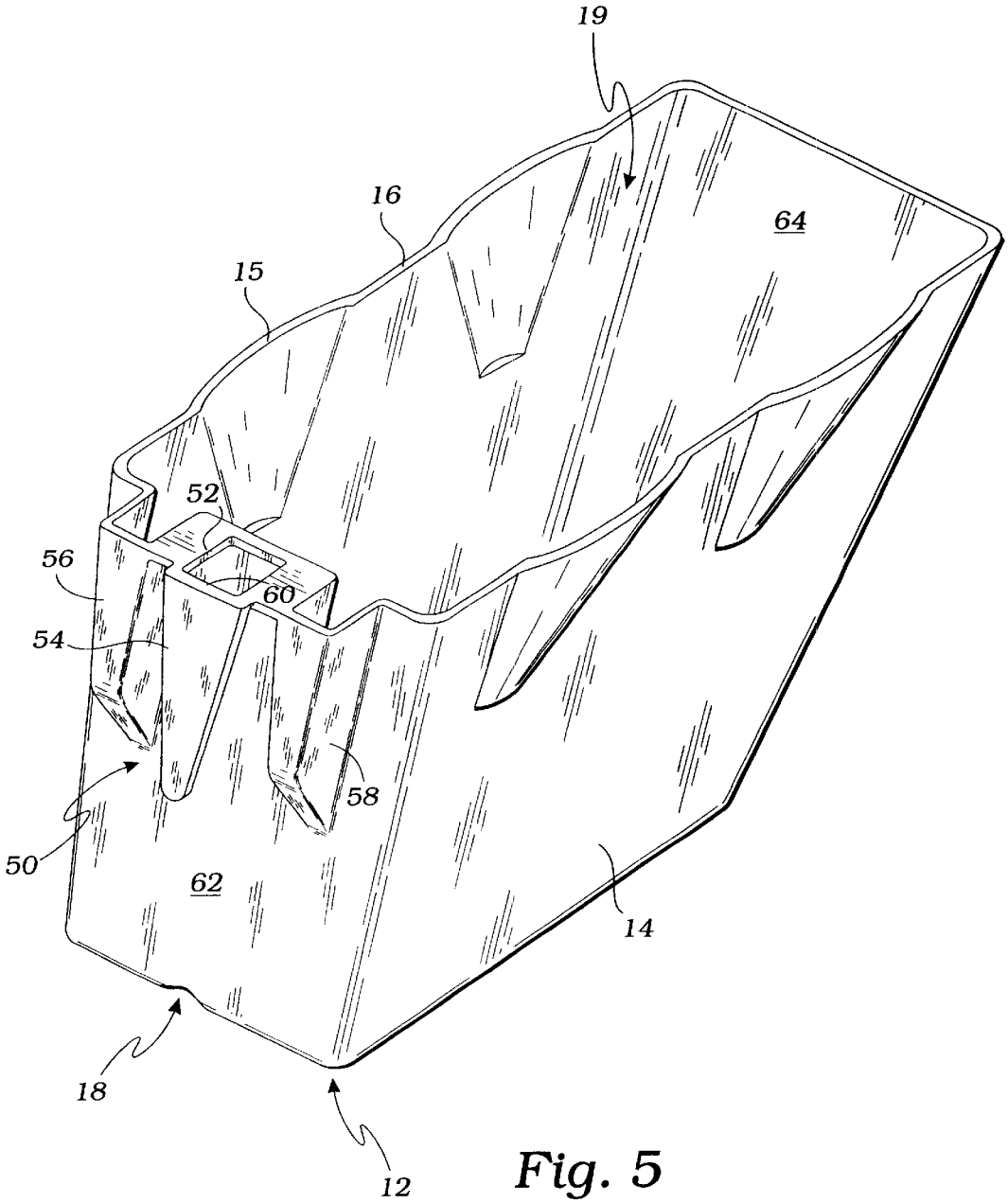
FIG. 5 is a perspective view of a condiment cup.

As shown in FIGS. 1 and 5–7, the container 12 has a vertical sidewall 14 and a bottom 18 that cooperate to define a storage space 19. In the preferred embodiment, the storage container 20 is a lighter construction that is strong and rigid enough to hold either popcorn or another light food product or condiment, such as ketchup. The container 12 can vary considerably within the broad parameters described above. One form of the container 12, shown in FIG. 1, is similar to cardboard containers typically used to store popcorn. Another form of the container 12, as shown in FIG. 5, is constructed of molded plastic having a plurality of surface contours 15 designed to add structural integrity to the container 12. If the container 12 is constructed of a rigid plastic, it is preferred that the container 12 be relatively small in comparison to other food containers 12 so as to not interfere with the disposal of the container 12 following use.

First Embodiment

In a first embodiment, as shown in FIGS. 1–4, the container attachment device 10 includes first and second attachment elements 30 and 36 that can be attached to the storage container 20 and the container 12, respectively, to make them readily interconnected. The first attachment element 30 has a means for providing an attachment point 32. The first attachment element 30 further has a means for attaching 34 the first attachment element 30 to the storage container vertical sidewall 22 of the storage container 20. In the preferred embodiment, the as means for providing an attachment point 32 is a rigid tongue 32 shaped to removably engage the second attachment element 36, as described below. It will be readily understood by those skilled in the art, however, that the interlocking portions of the first and second attachment elements 30 and 36 can be reversed without altering the invention or escaping the scope of the claimed invention. In the preferred embodiment, the means for attaching 34 is a first anchor 34 having a first adhesive backing 35. The first attachment element 30 is preferably a paper, cardboard, or plastic element having an adhesive backing over a portion of the first attachment element 30, although many configurations are possible using a wide range of materials, as long as the required features are enabled.

The second attachment element 36 has a means for removably engaging 38 the means for providing an attachment point 32. The second attachment element 36 further has a means for fastening 40 the second attachment element 36 to the vertical sidewall 14 of the container 12.

In the preferred embodiment, the means for fastening 40 the second attachment element 36 to the container 12 is provided by a second anchor 40A and a third anchor 40B. The second and third anchors 40A and 40B preferably include a first and second adhesive backing 41A and 41B, similar to the first adhesive backing 35 of the first anchor 34, useful for attaching the second attachment element 36 to the container 12. In the preferred embodiment, the means for removably engaging 38 is a bridge shaped to connect the second and third anchors 40A and 40B such that when the second and third anchors 40A and 40B are attached to the container 12 by the second and third adhesive backings 41A and 41B, the rigid tongue 32 of the first attachment element 30 can be removably engaged between the bridge 38 and the container 12. The second attachment element 36, similar to the first attachment element 30, is preferably a paper, cardboard, or plastic element strong enough to support the container 12 when the container 12 is full of food.

Those skilled in the art will recognize that the specific engagements structure created by the combination of the first and second attachment elements 30 and 36 is not strictly limited to the structure described herein. Equivalent structures, such as a plurality of attachment arms and bridges, and alternative mutually engaging shapes and structures, should be considered within the scope of the present invention.

Figure 2:
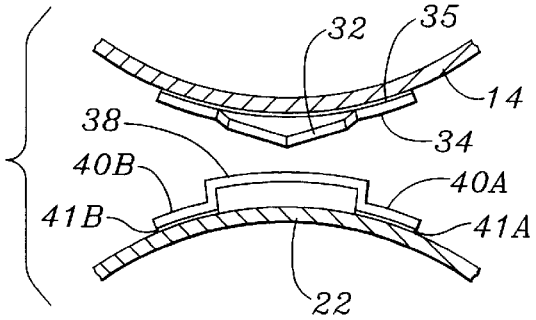
FIG. 2 is a top plan view of first and second attachment elements showing the first attachment element adjacent to the second attachment element.
Figure 3:
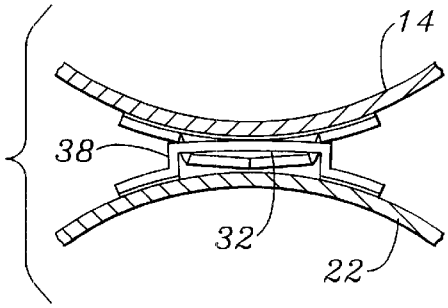
FIG. 3 is a top plan view thereof showing the first attachment element inserted into the second attachment element.
Figure 4:
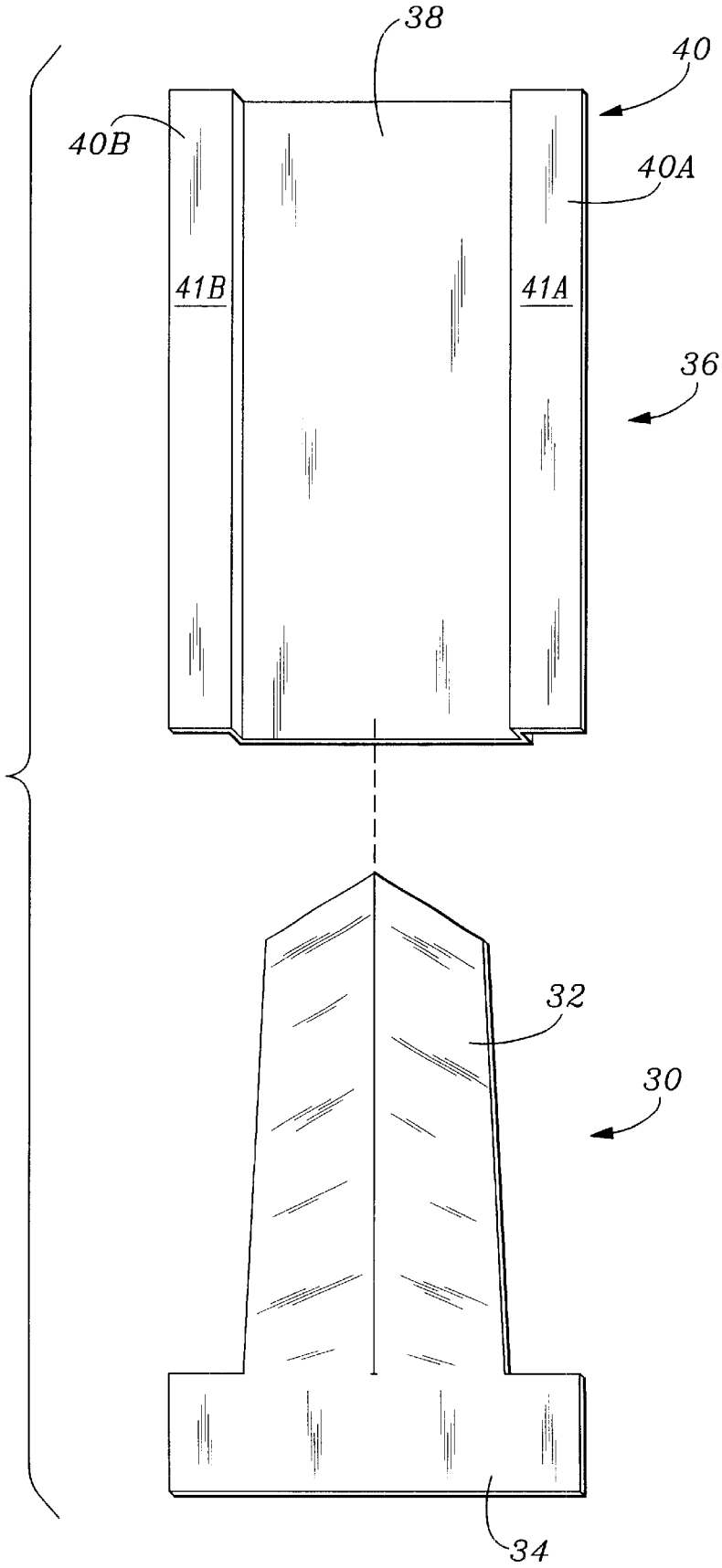
FIG. 4 is an exploded front elevational view thereof.

As shown in FIGS. 2–4, the first and second attachment elements 30 and 36 are attached to the container 12 and the storage container 20, respectively. The first attachment element 30 is preferably attached to the container 12 with a first adhesive backing 35. The second attachment element 36 is preferably attached to the storage container 20 with second and third adhesive backings 41A and 41B. When the first and second attachment elements 30 and 36 are attached to the container 12 and the storage container 20, they convert the container 12 and the storage container 20 into a pair of interconnecting containers 42, as shown in FIG. 1.

The first and second attachment elements 30 and 36 are preferably attached to the container 12 and the storage container 20 during the manufacture of the container 12 and the storage container 20; however, in an alternative embodiment, the first and second attachment elements 30 and 36 are attached to prior art containers 12 at the point of sale, such as a movie theater, either by employees or by the end user. In this manner, the container 12 full of lighter food such as popcorn can be easily carried in association with the storage container 20 full of heavier food or drink.

Second Embodiment

While the first embodiment includes first and second attachment elements 30 and 36 that are separate from the container 12 and the storage containers 20, this is not necessarily required. In a second embodiment, as shown in FIGS. 5–8, the first attachment element 30 is provided by a lip 24 of the storage container vertical sidewall 22 of the storage container 20; and the second attachment element 36 is provided by an integral attachment arm 50 extending downwardly from the vertical sidewall 14.

Figure 8:
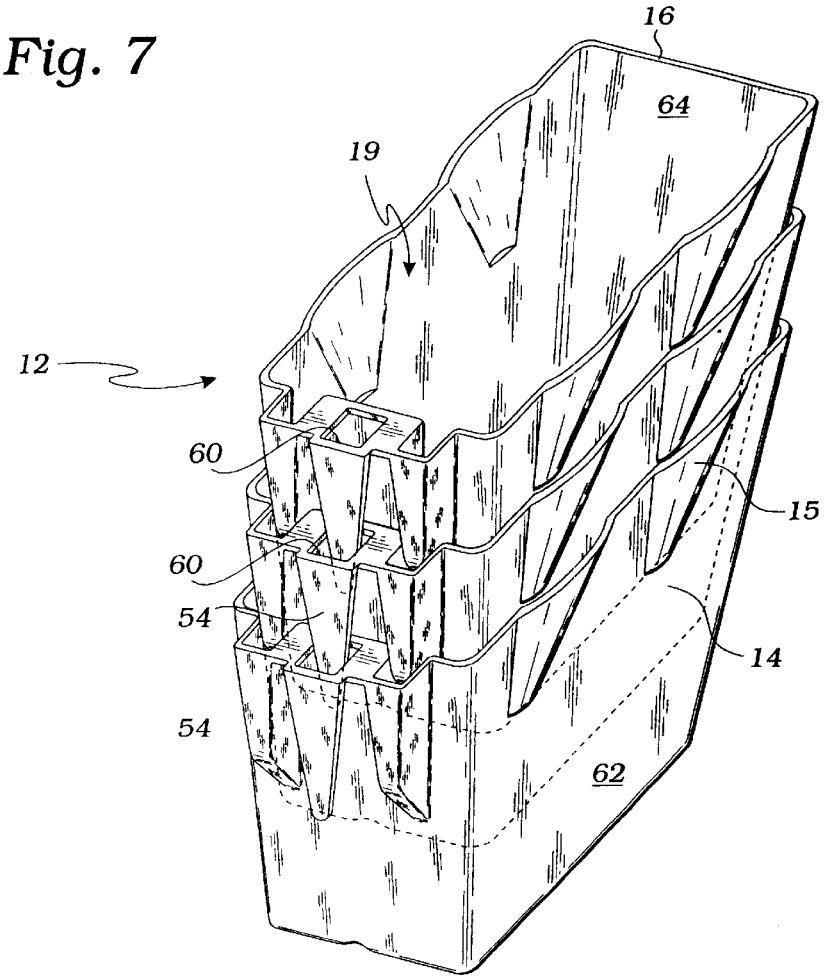
FIG. 8 is a perspective view of a plurality of the containers stored in a nesting relationship.

As shown in FIG. 5, the integral attachment arm 50 preferably includes an outwardly extending portion 52 and a downwardly extending portion 54, the outwardly extending portion 52 spacing the downwardly extending portion 54 from the vertical sidewall 14. In this embodiment, the vertical sidewall 14 preferably further includes a first ridge 56 and a second ridge 58. The first and second ridges 56 and 58 are parallel to and horizontally spaced from either side of the integral attachment arm 50. The first and second ridges 56 and 58 preferably extend outward from the vertical sidewall 14 approximately the same distance as the outwardly extending portion 52 of the integral attachment arm 50. In the most preferred embodiment, the outwardly extending portion 52 includes a nesting aperture 60 shaped to receive the downwardly extending portion 54 of another container, thereby allowing the container 12 to nest within the storage space 19 of another container 12, as shown in FIG. 8.

Figure 6:
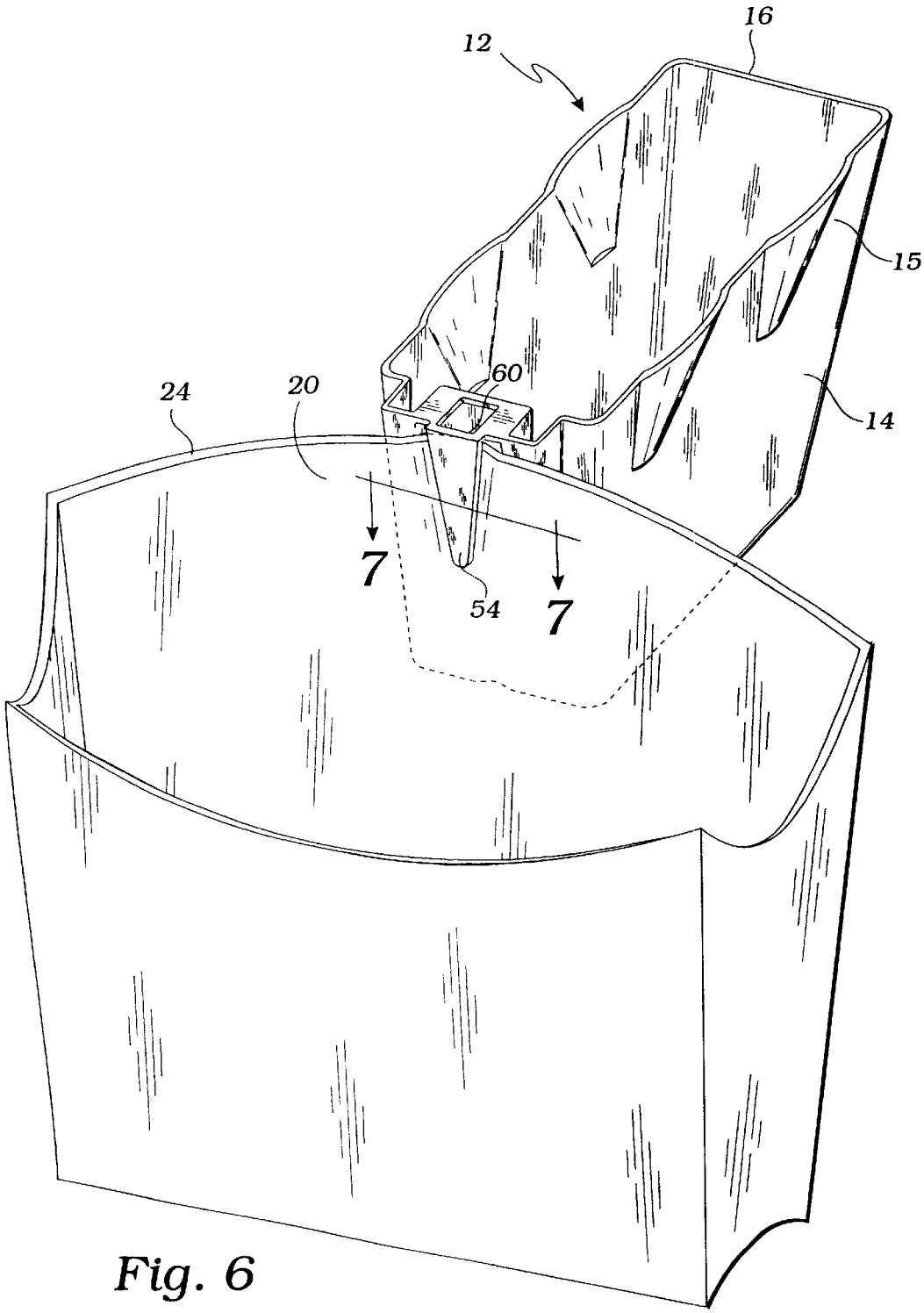
FIG. 6 is a perspective view of the condiment cup attached to a storage container with an integral attachment arm.
Figure 7:
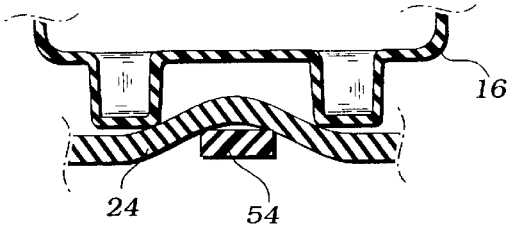
FIG. 7 is a sectional view thereof taken along line 7—7 in FIG. 6.

The combination of the integral attachment arm 50 and the first and second ridges 56 and 58 is a critical feature of the present invention. As shown in FIG. 6, the integral attachment arm 50 and the first and second ridges 56 and 58 cooperate to clamp the lip 24 and storage container vertical sidewall 22 of the storage container 20 therebetween; however, they also accommodate the curvature of the lip 24 of the storage container 20, as shown in FIG. 7. In this manner, the container 12 full of condiment such as ketchup can be easily carried in association with the storage container 20 full of heavier food such as french-fries.

Method of Use

The invention also includes a method for attaching the container 12 to the storage container 20 using the above-described first and second attachment elements 30 and 36. First, the container 12 and the storage container 20 described above is provided for use. In the first embodiment, the first attachment element 30 is attached to the storage container vertical sidewall 22 of the storage container 20 using the first adhesive backing 41A; and the second attachment element 36 is attached to the vertical sidewall 14 of the container 12. In the second embodiment, the required elements are provided during the manufacture of the container 12 and the storage container 20, the storage container 20 providing the lip 24 and the container 12 having the integral attachment arm 50.

Once the storage container 20 and the container 12 have their respective first and second attachment elements 30 and 36, the first and second attachment elements 30 and 36 are removably attached to each other, thereby removably attaching the container 12 to the storage container 20. This can be accomplished by inserting the rigid tongue 32 of the first attachment element 30 between the bridge 38 of the second attachment element 36 and the vertical sidewall 14 of the container 12, thereby supporting the container 12 by the storage container 20. Of course, the first and second attachment elements 30 and 36 will also function in the reverse, with the first attachment element 30 attached to the container 12 and the second attachment element 36 attached to the storage container 20.

In the second embodiment, the container 12 can be stored with other containers, each container 12 nesting within the storage space 19 of another container and the integral attachment arm 50 nesting within the nesting aperture 60. To facilitate this important nesting capability, the vertical sidewall 14 of the container 12 is contoured so that an outer surface 62 of the vertical sidewall 14 properly mates with an inner surface 64 of the vertical sidewall 14. Specifically, the first and second ridges 56 and 58 each have the inner surface 64 shaped to mate with the outer surface 62, so that the first and second ridges 56 and 58 do not impede the nesting ability of the container 12.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A condiment cup for attachment to a storage container, the storage container having a lip, the condiment cup comprising:

a container having a vertical sidewall defining a top opening for accessing a storage space of the container;

an integral attachment arm having an outwardly extending portion and a downwardly extending portion, the outwardly extending portion extending from the vertical sidewall adjacent the top opening and the downwardly extending portion extending downward roughly parallel to the vertical sidewall, the outwardly extending portion spacing the downwardly extending portion from the vertical sidewall; and a first ridge and a second ridge formed by the vertical sidewall, the first and second ridges being roughly parallel to and horizontally spaced from either side of the downwardly extending portion, the downwardly extending portion and the first and second ridges being spaced to clamp the lip of the storage container therebetween, the first and second ridges extend outward from the vertical sidewall approximately the same distance as the outwardly extending portion of the integral attachment arm.

* * * * *